US005268859A

United States Patent [19]

Filbert et al.

[11] Patent Number: 5,268,859

[45] Date of Patent: Dec. 7, 1993

[54] PROCESS FOR OBTAINING COMPENSATION QUANTITY TO COMPENSATE THE NONUNIFORMITY OF A SURFACE WAVE CONVOLVER

[75] Inventors: Dieter Filbert; Rainer Klatte; Andreas Wolf, all of Berlin, Fed. Rep. of Germany

[73] Assignee: Siemens Aktiengesellschaft, Munich, Fed. Rep. of Germany

[21] Appl. No.: 776,317

[22] PCT Filed: May 11, 1990

[86] PCT No.: PCT/DE90/00357

§ 371 Date: Feb. 18, 1992

§ 102(e) Date: Feb. 18, 1992

[87] PCT Pub. No.: WO90/16040

PCT Pub. Date: Dec. 27, 1990

[30] Foreign Application Priority Data

Jun. 16, 1989 [DE] Fed. Rep. of Germany ..... 3920170

[51] Int. Cl.[5] ..... G06G 7/12

[52] U.S. Cl. ..... 364/821

[58] Field of Search ..... 364/821, 728.03; 310/313 R; 333/193

[56] References Cited

U.S. PATENT DOCUMENTS 4,635,221 1/1987 Kerr ..... 364/821

5,164,628 11/1992 Egara et al. ..... 364/821 X

OTHER PUBLICATIONS

ICASSP 83, IEEE International Conference on Acoustics, Speech and Signal Processing Proceeding, Apr. 14–16, 1983, Boston, Mass., vol. 1, IEEE, (New York, US), A. Morgul et al.: "Wideband Frequency Domain Adaptive Filter Module", pp. 1.2.5–1.2.8.

Electronics Letters, vol. 16, No. 4, Feb. 14, 1980, (Hitchin, Herts, GB), D. Behar et al.: "Storage Correlator as an Adaptive Inverse Filter", pp. 130–131.

G. S. Kino: "Acoustic Waves: Devices, Imaging and Analog Signal Processing", 1987, (Prentice Hall, Englewood Cliffs, US), pp. 480–499.

IEEE Transactions on Sonics and Ultrasonics, vol. SU-32, No. 5, Sep. 1985, IEEE (New York, US), H. P. Grassl et al.: "Small-aperture focusing chirp transducers vs. Diffraction-compensated beam compressors in elastic SAW convolvers", pp. 675–684.

Elektronik, Dr. H. P. Grassl, vol. 6, Mar. 22, 1985, pp. 61–66.

*Primary Examiner*—Tan V. Mai

*Attorney, Agent, or Firm*—Kenyon & Kenyon

[57] ABSTRACT

A process obtains a compression quantity to compensate the nonuniformity of a surface wave convolver. A surface wave convolver includes an elongate piezoelectric crystal, to the ends of which interdigital transducers are fitted to convert electrical input signals applied to signal inputs into acoustic surface waves. At its integration electrode it is possible to pick off an output signal which corresponds to the convolution product of the electrical input signals. In order to compensate errors caused by the nonuniformity of the surface wave convolver in consequence of inhomogeneities of its integration electrode and of the piezoelectric crystal, a constant input signal is applied to one of the signal inputs and a predeterminable signal which determines a desired pulse response of the surface wave convolver, it is applied to the other signal input of the surface wave convolver. The output signals are freed from stochastic disturbing components by averaging to form the compensation quantity which is stored in a memory. The compensation quantity is used to compensate the output signal of the surface wave convolver convolving with the predeterminable signal in synchronism with the reading out of the compensation quantity from memory, when input signals to be processed are applied to the signal input.

3 Claims, 3 Drawing Sheets

PROCESS FOR OBTAINING COMPENSATION QUANTITY TO COMPENSATE THE NONUNIFORMITY OF A SURFACE WAVE CONVOLVER

BACKGROUND OF THE INVENTION

An article by Dr. techn. H.-P. Grasal in "Elektronik" 6/22.03.1985, pages 61 et seq., discloses a surface wave convolver which is used as a signal-processing component. The surface wave convolver described therein consists of an elongate piezoelectric substrate, to one end of which a first interdigital transducer is fitted, one connection of which serves as signal input for electrical input signals to be processed. These input signals are converted by the interdigital transducer into acoustic surface waves which propagate along a propagation surface defined by an integration electrode on the piezoelectric substrate. At the other end of the piezoelectric substrate there is disposed a further interdigital transducer, one connection of which serves as a signal input for a predeterminable electrical signal which is converted, in a similar manner, into acoustic surface waves which propagate on the piezoelectric substrate in the direction of the first interdigital transducer. In this manner, the surface wave convolver executes a physical folding of the electrical signals which are present at its signal inputs. The signal output of the convolver is formed by a point of connection of the integration electrode. At this signal output it is possible to pick off a convolver output signal, which is proportional to the convolution integral of the two input signals, as long as those signal components of the input signals which contribute to the result of the convolution are found, in a condition entirely converted into surface waves, under the integration electrode of the surface wave convolver. The integration period of the surface wave convolver is determined by the ratio of the length of the integration electrode to the propagation velocity of the surface waves on the substrate.

An article by H.-P. Grassl and H. Engan ("Small-Aperture Focusing Chirp Transducers vs. Diffraction-Compensated Beam Compressors in Elastic SAW Convolvers" in "IEEE Transactions on Sonics and Ultrasonics", Vol. Su-32, No. 5, Sep. 1985) discloses that real surface wave convolvers exhibit a nonuniformity. This is due, among other reasons, to the fact that the signal components forming the convolver output signal originate from arbitrary locations under the integration electrode. In order to permit an approximately equal amplitude weighting and phase retardation for all these signal components on their path to the signal output, the integration electrode is designed as a gathering and matching grid having a plurality of pick-off points uniformly distributed over its entire length. A variation of the electrical parameters in the grid structure of the integration electrode, a variation of the series resistance of the propagation surface and, especially, standing-wave effects of nonlinearly generated longitudinal waves where the substrate thicknesses are not constant lead to a nonuniformity of the surface wave convolver. Accordingly, the uniformity is interpretable as a weighting function of the integration electrode. In operation of the surface wave convolver, i.e., when the input signals to be processed are applied to one of its signal inputs and a predeterminable signal, which corresponds to the desired pulse response of the surface wave convolver (programmable filter), is applied to its other signal input, the nonuniformity leads to a situation in which that output signal of the surface wave convolver which represents the result of convolution of the input signals is affected by a considerable error. Even where the greatest care is taken in the production of the surface wave convolver, the abovementioned causes of the nonuniformity cannot be entirely eliminated.

SUMMARY OF THE INVENTION

The present invention provides a simple process by which the influence of the nonuniformity of a surface wave convolver on the output signal can be compensated.

According to the present invention, there is a process for obtaining a compensation quantity to compensate the nonuniformity of a surface wave convolver that has a first signal input to which input signals to be processed can be applied, a second signal input to which a predeterminable signal can be applied and a signal output. A constant input signal is applied to the first signal input and at the same time the predeterminable signal is applied to the second signal input. An output signal which can be picked off at the signal output is fed to a memory and is stored in the latter as a compensation quantity. The input signals to be processed are then applied to the first signal input while maintaining the predeterminable signal at the second input and the compensation quantity is fed to the output signal of the surface wave convolver in synchronism. In this manner, a compensation quantity is associated with the predeterminable signal at the second signal input of the surface wave convolver in a simple manner, by which compensation quantity the error of the output signal of the surface wave convolver due to the nonuniformity can be compensated for to an extremely great extent. It can be shown, by considerations based on signal theory, that the remaining residual error of the output signal due to the nonuniformity is zero in the case of constant input signals to be processed, while in the case of non-constant input signals to be processed the error of the convolver output signal can be compensated apart from a residual error which is determinable in accordance with the formula:

$$F_{ks}(t) = 1 - \frac{g_k(t)}{g^{j}_{uv}(t)} \text{ in\%};$$

$$= 1 - \left[ \frac{\int_{-\infty}^{+\infty} III\left(\frac{\epsilon}{To}\right) \cdot e_{cu}(\epsilon - t) \cdot u(2t - \epsilon) \cdot d\epsilon}{\frac{1}{To} \cdot \int_{-\infty}^{+\infty} III\left(\frac{g}{To}\right) \cdot e_{cu}(\epsilon - t) \cdot d\epsilon \cdot \int_{-\infty}^{+\infty} III\left(\frac{\epsilon}{To}\right) \cdot u(2t - \epsilon) \cdot d\epsilon} \right].$$

where the following symbols have the meanings indicated:

$g_x(t)$: compensated output signal of the surface wave convolver, $g_u^i(t)$: output signal of a uniform (theoretical) surface wave convolver, u(t)f V(t): input signals of the surface wave convolver, $T_o$: pulse duration of the predeterminable signal.

A particularly advantageous aspect of the process according to the present invention is that the error due to the nonuniformity of the surface wave convolver can be reduced to zero without changes to the physical structure of the surface wave convolver and without costly external wiring arrangements. A further advantage is that the process according to the present invention can be performed automatically in a simple manner, for example in all cases where a different predeterminable signal is to be employed. Since a compensation quantity is definitely associated with each predeterminable signal, this compensation quantity can be filed in a memory and called up again when required.

An advantageous further development of the process according to the present invention provides that the compensation quantity is inverted and the inverse compensation quantity is multiplied in synchronism by the output signal of the surface wave convolver. The linkage of the output signal with the inverse compensation quantity represents a feed of the compensation quantity which can be performed in a particularly simple manner in terms of circuit technology.

BRIEF DESCRIPTION OF THE DRAWINGS

The process according to the present invention is explained in the following with reference to the drawings.

DETAILED DESCRIPTION

Figure 1:
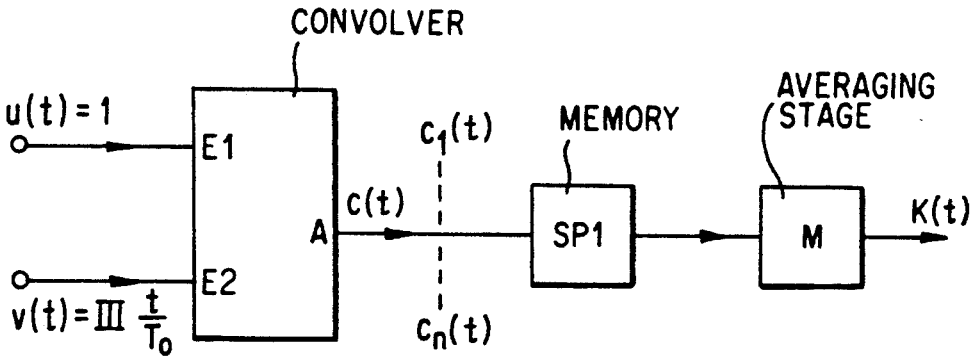
FIG. 1 shows a signal progression for recording a compensation quantity.

FIG. 1 shows a surface wave convolver C having two signal inputs E1 and E2. The signal input E1 has applied thereto a constant input signal u(t), which is normalized to the value 1. In this case, the normalization to the value 1 means that the input signal u(t) permits a maximum control of the surface wave convolver C. The signal input E2 has applied thereto a predeterminable signal v(t) in the form of a rectangular function with a pulse duration $T_o$. The predeterminable signal v(t) determines the pulse response of the surface wave convolver C which acts as a (programmable filter). The pulse response of a system is understood to refer to the system reaction (i.e. the output signal) of the system when a Dirac pulse is applied on the input side (cf., for example, Otto Mildenberger "Grundlagen der Systemtheorie für Nachrichtentechniker" ("Principles of system theory for communications engineers"), Hanser Verlag, 1981, pp. 48–50). At an output A of the surf ace wave convolver C, it is possible to pick off an output signal $$c(t)=T_o \cdot E(t) \qquad \text{Equation 1}$$

which represents the convolution product of the surface wave convolver C, effected by an error function E(t), and is proportional to the pulse duration $T_o$ of the predeterminable signal v(t). However, the magnitude of the output signal c(t) can be increased only up to certain limits by increasing the pulse duration $T_o$, as the surface wave convolver C can process only time-limited input signals. The recording of the output signal c(t) is repeated n-times, and the respective output signals $c_1(t)$ to $c_n(t)$ are fed to a memory component SP1 and stored in the latter. After this, an averaging of the output signals $c_1(t)$ to $C_n(t)$ is undertaken in an averaging stage M. This leads to the formation of a compensation quantity K(t), which is free from stochastic disturbing influences and which can be interrogated at the output of the averaging stage M.

Figure 2:
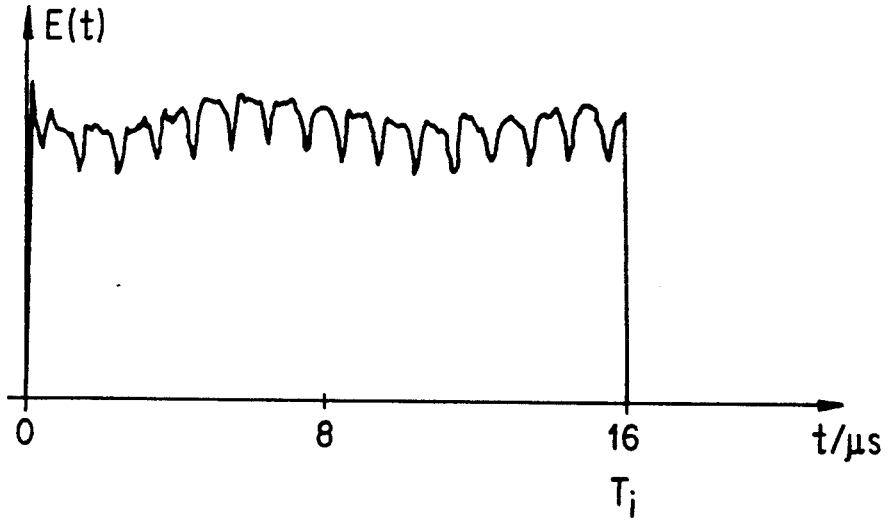
FIG. 2 shows a progression of the convolver output signal at the convolver output according to FIG. 1.

A typical progression of an error function E(t), which shows the nonuniformity of a surface wave convolver, is represented in FIG. 2. It is possible to observe a relatively sharply defined progression of the error function E(t), the duration of which is determined by the duration of integration $T_i$ of the surface wave convolver. The error function E(t) shown arises as a result of the folding of a rectangular pulse—which exhibits, in approximation to a Dirac pulse, a relatively short pulse duration $T_o$ in the ns nanosecond range—as predeterminable signal v(t) with a constant input signal u(t). In the case of an entirely uniform surface wave convolver, there would be an exact rectangular pulse, the duration of which would correspond to the duration of integration $T_i$ of the surface wave convolver. On the other hand, FIG. 2 shows periodically recurrent relative minima of the error function E(t), which give an indication of the arrangement of the pick-off points of the integration electrode of the real surface wave convolver.

Figure 3:
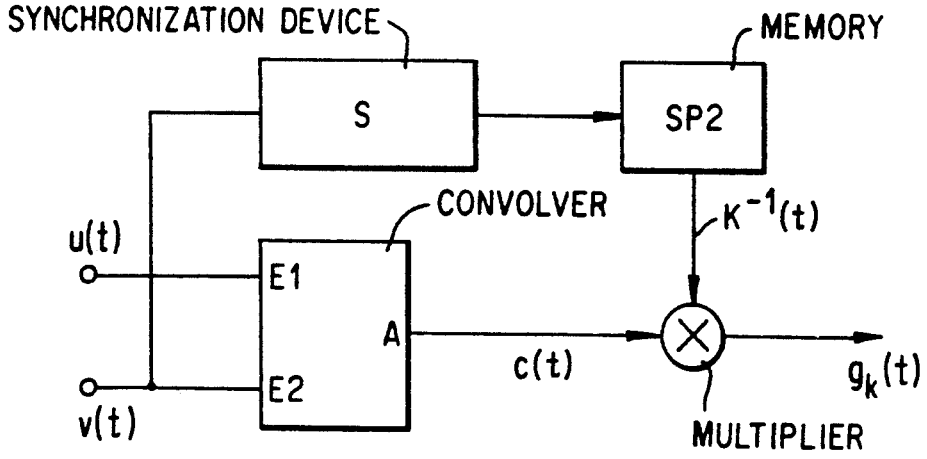
FIGS. 3 to 9 show further signal progressions to explain the process according to the present invention.

FIG. 3 shows the surf ace wave convolver C in normal operation, in which input signals u(t) to be processed are applied to signal input E1 and the predeterminable input signal v(t), which determines its pulse response, is applied to its signal input E2, which predeterminable input signal corresponds to the input signal v(t) according to FIGS. 1 and 2. The inverse compensation quantity $K^{-1}(t)$ is stored in a memory component SP2, which inverse compensation quantity is formed by inversion of the compensation quantity K(t). A synchronising device S synchronises the inverse compensation quantity $K^{-1}(t)$ which can be picked off from the memory component SP2, having regard to the transit time delays, occurring as a result of physical effects in the surface wave convolver, with the time progression of the predeterminable input signal v(t). The inverse compensation quantity $K^{-1}(t)$ is multiplied, by means of a multiplier M, by the output signal c(t) of the surface wave convolver C. This produces an output signal $g_k(t)$, which is free from the error due to the nonuniformity of the surface wave convolver C, entirely (where the input signal u(t) to be processed is constant within a time interval of $t \pm T_o/2$) or to a large extent (if the input signal u(t) is not constant within the time interval $t \pm T_o/2$).

Figure 4:
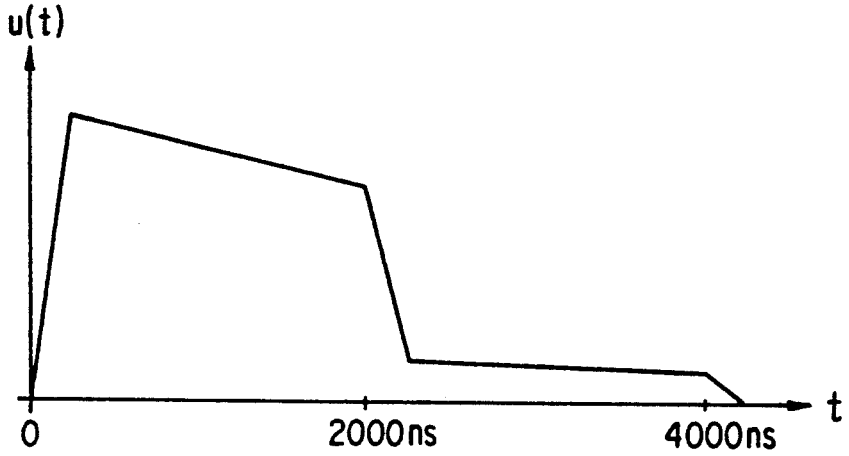
Figure 5:
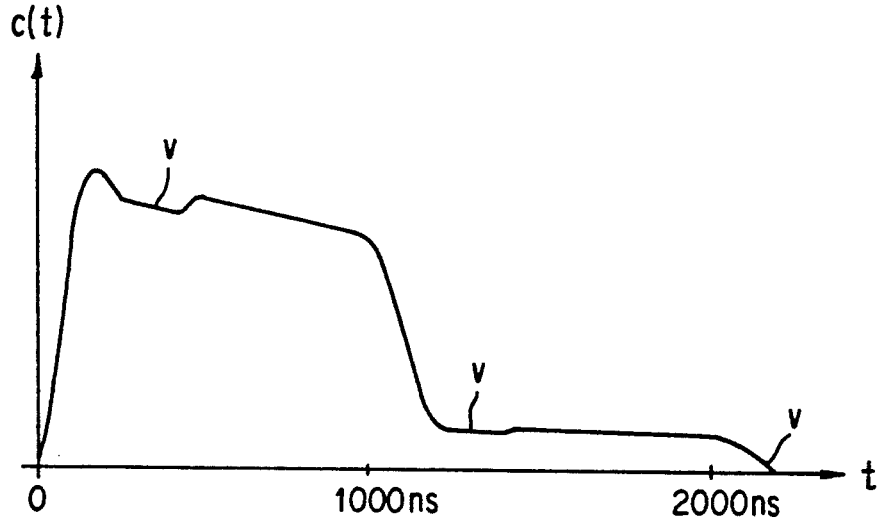

FIG. 4 shows the time progression of an input signal u(t), which is applied to the signal input E1 of the surface wave convolver C according to FIG. 3. The output signal c(t) at the output A of the surface wave convolver C exhibits a progression according to FIG. 5. In this case, the output signal c(t) is weighted with the pulse response of the surface wave convolver C, which pulse response is predetermined by v(t); as a result of the nonuniformity of the surface wave convolver C, the output signal c(t) exhibits considerable distortions V in the region of discontinuous changes to the input signal u(t); in the other regions, the output signal c(t) is represented in an undistorted condition, for the sake of a simplified representation. The time compression of the signal c(t) in comparison with the input signal u(t) to be processed, by the factor two, is substantiated in that the input signals of the surface wave convolver C which are converted into acoustic surface waves move together in the convolver in opposite directions.

Figure 6:
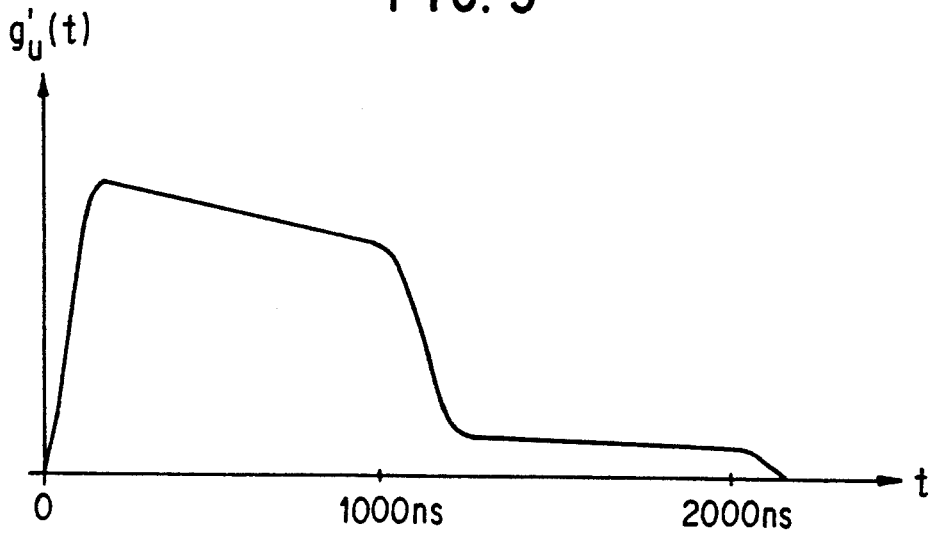

FIG. 6 shows a theoretical output signal $g_u^i(t)$ of a uniform surface wave convolver where the input signal u(t) to be processed, which is in accordance with FIG. 4, is applied thereto.

Figure 7:
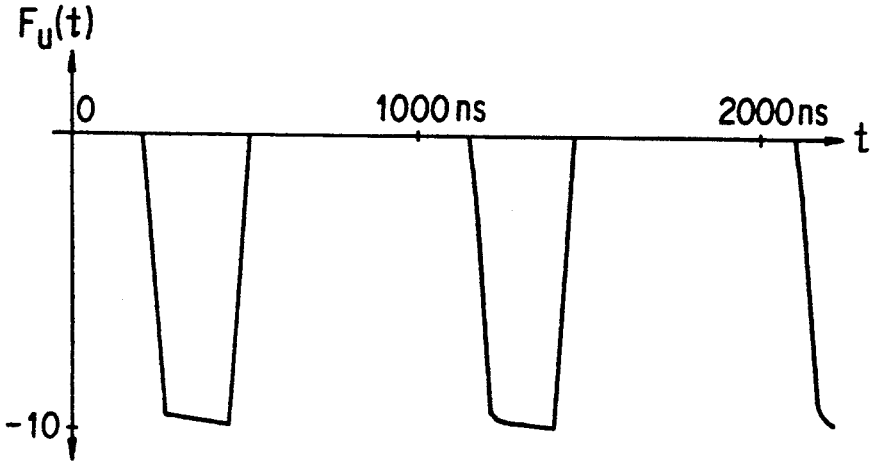

FIG. 7 shows a uniformity error $F_u(t)$ which is obtained from the percentage deviation of the output signal c(t) of the nonuniform surface wave convolver C from the output signal $g_u^i(t)$ of a uniform (theoretical) surface wave convolver according to FIG. 6.

Figure 8:
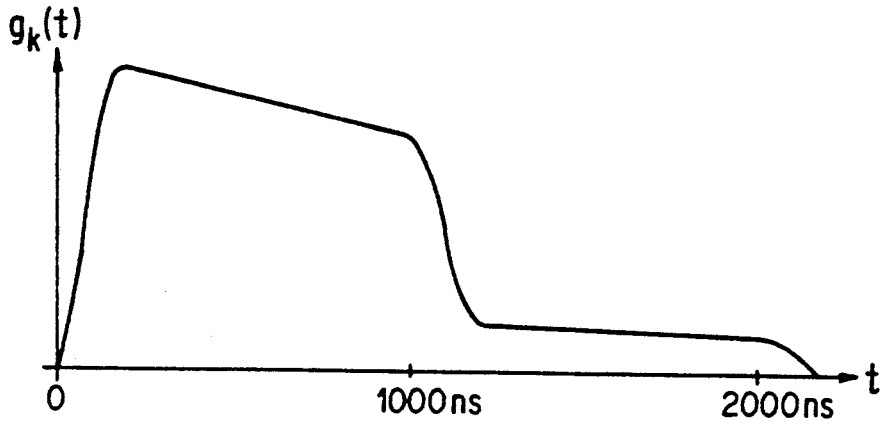
Figure 9:
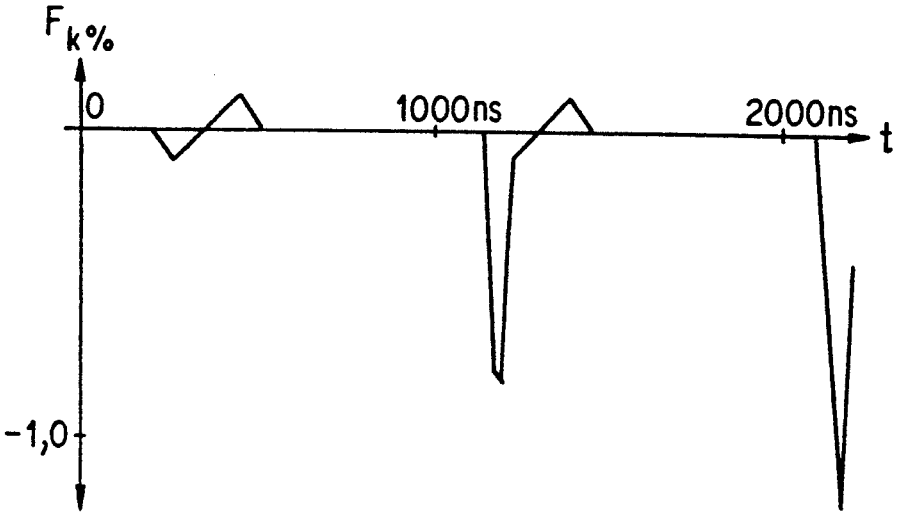

FIG. 8 shows the progression of the output signal $g_k(t)$ (cf. FIG. 3) after performance of the compensation, and FIG. 9 shows the progression of the percentage residual error $F_{k\%}(t)$ after performance of the compensation of the nonuniformity. It is possible to observe a a percentage residual error $F_{k\%}(t)$ in consequence of the nonuniformity of the surface wave convolver C in comparison with the uniformity error $F_u(t)$ represented in FIG. 7 and it is being possible to observe a reduction of the error caused by the nonuniformity by a factor of the order of magnitude of 10 (cf. FIG. 7).

What is claimed is:

1. A process for obtaining a compensation quantity and compensating for a nonuniformity of a surface wave convolver, comprising the steps of:

applying a constant input signal to a first signal input of the convolver and at the same time, applying a predeterminable signal to a second signal input of the convolver;

feeding an output signal, taken from a signal output of the convolver, to a memory in which an average output signal is stored as a compensation quantity;

applying input signals to be processed to the first signal input of the convolver while maintaining the predeterminable signal at the second signal input of the convolver, and compensating for the output signal of the surface wave convolver using the compensation quantity read from the memory in synchronism with convolution of the signals to be processed.

2. The process according to claim 1, wherein the step of compensating comprises the sub-steps of inverting the compensation quantity, and multiplying the inverse compensation quantity, in synchronism, by the output signal of the surface wave convolver.

3. A process for obtaining an output signal using a surface wave convolver, which signal is compensated with respect to a defect caused by the non-uniformity of the surface wave convolver, comprising the steps of:

applying a constant input signal to a first signal input of the convolver and at the same time applying a predeterminable signal to a second signal input of the convolver, wherein constant input signals to be processed are applied to the first signal input while maintaining the predeterminable signal at the second signal input;

performing a convolution integral of the constant input signal and of the predeterminable signal and providing a signal proportional to the convolution integral as an output of the convolver;

providing the output signal of the convolver to a memory and storing an average output signal in the memory as a compensation quantity; and multiplying the compensation quantity in synchronism with the output signal of the surface wave convolver to obtain a compensated output signal.

* * * * *